US007571825B2

(12) United States Patent
Takahashi

(10) Patent No.: US 7,571,825 B2
(45) Date of Patent: Aug. 11, 2009

(54) SAFETY CONTAINER

(75) Inventor: Shun Takahashi, Yokohama (JP)

(73) Assignee: Shiseido Company, Ltd., Tokyo (JP)

( * ) Notice: Subject to any disclaimer, the term of this patent is extended or adjusted under 35 U.S.C. 154(b) by 594 days.

(21) Appl. No.: 10/555,388

(22) PCT Filed: Apr. 27, 2004

(86) PCT No.: PCT/JP2004/006094

§ 371 (c)(1),
(2), (4) Date: Nov. 2, 2005

(87) PCT Pub. No.: WO2004/099022

PCT Pub. Date: Nov. 18, 2004

(65) Prior Publication Data

US 2006/0219651 A1 Oct. 5, 2006

(30) Foreign Application Priority Data

May 9, 2003 (JP) ..... 2003-131858

(51) Int. Cl.
*B65D 55/02* (2006.01)

(52) U.S. Cl. ..... 215/220; 215/217; 215/219

(58) Field of Classification Search ..... 215/217, 215/219, 220, DIG. 20, DIG. 34
See application file for complete search history.

(56) References Cited

U.S. PATENT DOCUMENTS

| | | | | | |
|---|---|---|---|---|---|
| 3,843,006 | A | * | 10/1974 | Naito et al. | 215/220 |
| 3,944,102 | A | * | 3/1976 | Grau | 215/251 |
| 6,085,920 | A | | 7/2000 | Moretti | |

FOREIGN PATENT DOCUMENTS

| | | |
|---|---|---|
| JP | 63-152555 | 6/1988 |
| JP | 4-100448 | 8/1992 |
| JP | 06-032364 | 2/1994 |
| JP | 2001-301783 | 10/2001 |

* cited by examiner

*Primary Examiner*—Anthony D Stashick
*Assistant Examiner*—Elizabeth Volz
(74) *Attorney, Agent, or Firm*—IPUSA, PLLC

(57) ABSTRACT

A safety container includes a container main body, an internal cap, and an external cap. The external cap is not rotated with the internal cap in a case where only the external cap is rotated in an opening direction. The external cap is rotated in a state where the external cap is pressed toward an internal cap side. The safety container includes an inner ring having an end part where an engaging part engaged at a top part of the opening part of the container main body is provided and another end part where a slide contact part is provided. The internal cap is rotated with the external cap while the internal cap slides and contacts the slide contact part, by rotating the external cap in a state where the external cap is pressed toward the internal cap side until a rotation angle reaches a designated angle.

5 Claims, 3 Drawing Sheets

SAFETY CONTAINER

TECHNICAL FIELD

The present invention generally relates to safety containers whereby caps are prevented from being opened in error, and more particularly, to a safety container which cannot be easily opened by a little child.

BACKGROUND ART

A safety container having a structure whereby a cap cannot be opened in error by a little child has been used as a container where medicines are contained.

As this kind of the safety container, a container which can be opened only when a cap is rotated while the cap is pressed, the so called press and turn type, is often used.

For example, an internal cap projection part projects from an upper surface of a top plate of an internal cap. The internal cap is fitted to an external cap rotatably and moveably in upper and lower directions. An external cap projection part projects from a bottom surface of a top plate of the external cap. The external cap projection part is formed so as to be engaged with the internal cap projection part at a position where the external cap goes down. An elastic body is inserted between the top plate of the internal cap and the top plate of the external cap so that the external cap is energized upward.

In this case, a big force is applied to the external cap projection part. Hence, when the external cap is formed by injection molding so that the external cap projection part has a big measure, a sink (depression) may be generated on the top plate where the external cap projection part is provided. As a result of this, a concave part is formed on the top surface of the top plate of the external cap and thereby the commercial value of the cap may be degraded.

In order to solve such a problem, the following structure is suggested. That is, a part connecting to the top plate of the external cap is divided into plural members and therefore a force applied to the external cap is dispersed, and widths of respective members are made thin and therefore the members are cooled and hardened soon, so that the concave part due to the sink (depression) at the time of molding is prevented from being formed.

However, in the above-discussed safety container, while a certain force is required to press and rotate the cap by a rotation angle such as 20 through 30 degrees, the cap can be rotated with almost no force after such a rotation so that the container can be opened. Because of this, if the little child accidentally presses and rotates the cap, the cap may be opened.

DISCLOSURE OF THE INVENTION

Accordingly, it is a general object of the present invention to provide a novel and useful safety container.

Another and more specific object of the present invention is to provide a safety container wherein a cap cannot be easily opened when the cap is pressed and rotated in error.

The above object of the present invention is achieved by a safety container, including:

a container main body;

an internal cap configured to be fit to an opening part of the container main body; and an external cap configured to be fit to the internal cap rotatably and moveably in upper and lower directions;

wherein the external cap is not rotated with the internal cap in a case where only the external cap is rotated in an opening direction;

wherein the external cap is rotated in a state where the external cap is pressed toward an internal cap side so that the external cap and the internal cap are engaged and the internal cap is opened and separated from the container main body;

wherein the safety container further comprises an inner ring having an end part where an engaging part engaged at a top part of the opening part of the container main body is provided and another end part where a slide contact part is provided; and wherein the internal cap is rotated with the external cap while the internal cap slides and contacts the slide contact part, by rotating the external cap in the opening direction in a state where the external cap is pressed toward the internal cap side until a rotation angle reaches a designated angle.

According to the above-mentioned structure, it is possible to obtain a safety container wherein a cap cannot be easily pressed and rotated by a little child, for example, by properly adjusting the size of a slide contact resistance when the internal cap slides and contacts to a slide contact part so as to be rotated.

An elastic concave and convex structure may be provided at the periphery projection and the slide contact part so as to slide and contact while the external cap is rotated in the opening direction so that the periphery projection and the slide contact part receive a resistance force greater than a resistance force generated by rotating the external cap in the closing direction.

The above object of the present invention is achieved by a safety container, including:

a container main body;

a cap; and an inner ring;

wherein a thread is formed on a periphery wall external surface of an opening part of the container main body;

wherein the cap includes an internal cap and an external cap configured to be fit to the internal cap rotatably and moveably in upper and lower directions;

wherein a thread engaging with the thread of the container main body is formed on a periphery wall internal surface of the internal cap;

wherein the internal cap includes a periphery projection provided on an internal surface of a top wall so as to be formed downward;

an internal projection projecting upward from an external periphery part of the top wall; and an engaging plate fixed to a side surface of the internal projection, extending in a direction along a periphery wall, and having an end part where a projection part is formed;

wherein the projection part includes a tilt surface wherein a width is spread toward an external periphery side in a direction along an external periphery wall, and a stand surface provided in a center direction;

wherein the external cap includes an external projection provided on an external periphery part of an internal surface of a top wall so as to be formed projecting downward;

an engaging projection projecting from a periphery wall internal surface; and an elastic body provided on an internal surface of the top wall so as to be formed facing downward and exerting a force on the internal cap by being pressed;

wherein the inner ring includes an engaging part engaged at a top part of the opening part of the container main body and an internal surface where a slide contact part is provided;

wherein the engaging projection comes in contact with the stand surface of the projection part so as to engage the engaging plate, and the internal cap is rotated together with the external cap so that the opening part is closed by the top wall, by rotating the external cap in the closing direction;

wherein, in a case where only the external cap is rotated in an opening direction, the engaging projection is slid by the tilt surface of the projection so that the engaging projection is not engaged with the engaging plate and the external cap is not rotated with the internal cap; and wherein, by rotating the external cap in the opening direction in a state where the external cap is pressed to a side of the internal cap, the elastic body is bent, the external projection is engaged with the inner projection, and the internal cap is rotated together with the external cap while the external surface of the periphery projection slides and contacts the slide contact part, so that the opening part is opened from the top wall.

An elastic concave and convex structure may be provided at the periphery projection and the slide contact part so as to slide and contact while the external cap is rotated in the opening direction so that the periphery projection and the slide contact part receive a resistance force greater than a resistance force generated by rotating the external cap in the closing direction.

According to the above-mentioned structure, a force necessary for rotating the external cap in the closing direction can be made small.

The above object of the present invention is achieved by a safety container, including:

a container main body; and a cap;

wherein a thread is formed on a periphery wall external surface of an opening part of the container main body;

wherein the cap includes an internal cap and an external cap configured to be fit to the internal cap rotatably and moveably in upper and lower directions;

wherein a thread engaging with the thread of the container main body is formed on a periphery wall internal surface of the internal cap;

wherein the internal cap includes an internal projection projecting upward from an external periphery part of the top wall;

an engaging plate fixed to a side surface of the internal projection, extending in a direction along a periphery wall, and having an end part where a projection part is formed;

wherein the projection part includes a tilt surface wherein a width is spread toward an external periphery side in a direction along an external periphery wall, and a stand surface provided in a center direction;

wherein the external cap includes an external projection provided on an external periphery part of an internal surface of a top wall so as to be formed projecting downward;

an engaging projection projecting from an internal surface of a periphery wall; and an elastic body provided on an internal surface of the top wall so as to be formed facing downward and exerting a force on the internal cap by being pressed;

wherein the engaging projection comes in contact with the stand surface of the projection part so as to engage the engaging plate, and the internal cap is rotated together with the external cap so that the opening part is closed by the top wall, by rotating the external cap in the closing direction;

wherein, in a case where only the external cap is rotated in an opening direction, the engaging projection is slid by the tilt surface of the projection so that the engaging projection is not engaged with the engaging plate and the external cap is not rotated with the internal cap;

wherein by rotating the external cap in the opening direction in a state where the external cap is pressed to a side of the internal cap, the elastic body is bent, and the external projection is engaged with the inner projection, wherein, until the rotation angle reaches a designated angle, the engaging projection is slid and contacted by the tilt surface while the engaging projection receives a designated resistance, and the internal cap is rotated together with the external cap, so that the opening part is opened from the top wall, and wherein a configuration of either the projection part or the engaging projection or configurations of both of the projection part and the engaging projection are adjusted so that a size of the resistance is adjusted.

Here, a designated resistance means a resistance whereby the external cap cannot be rotated in the opening direction in a state where the internal cap is pressed by the force of the little child, for example. The designated resistance is properly set as a design condition.

Other objects, features, and advantages of the present invention will become more apparent from the following detailed description when read in conjunction with the accompanying drawings.

BEST MODE FOR CARRYING OUT THE INVENTION

Figure 1:
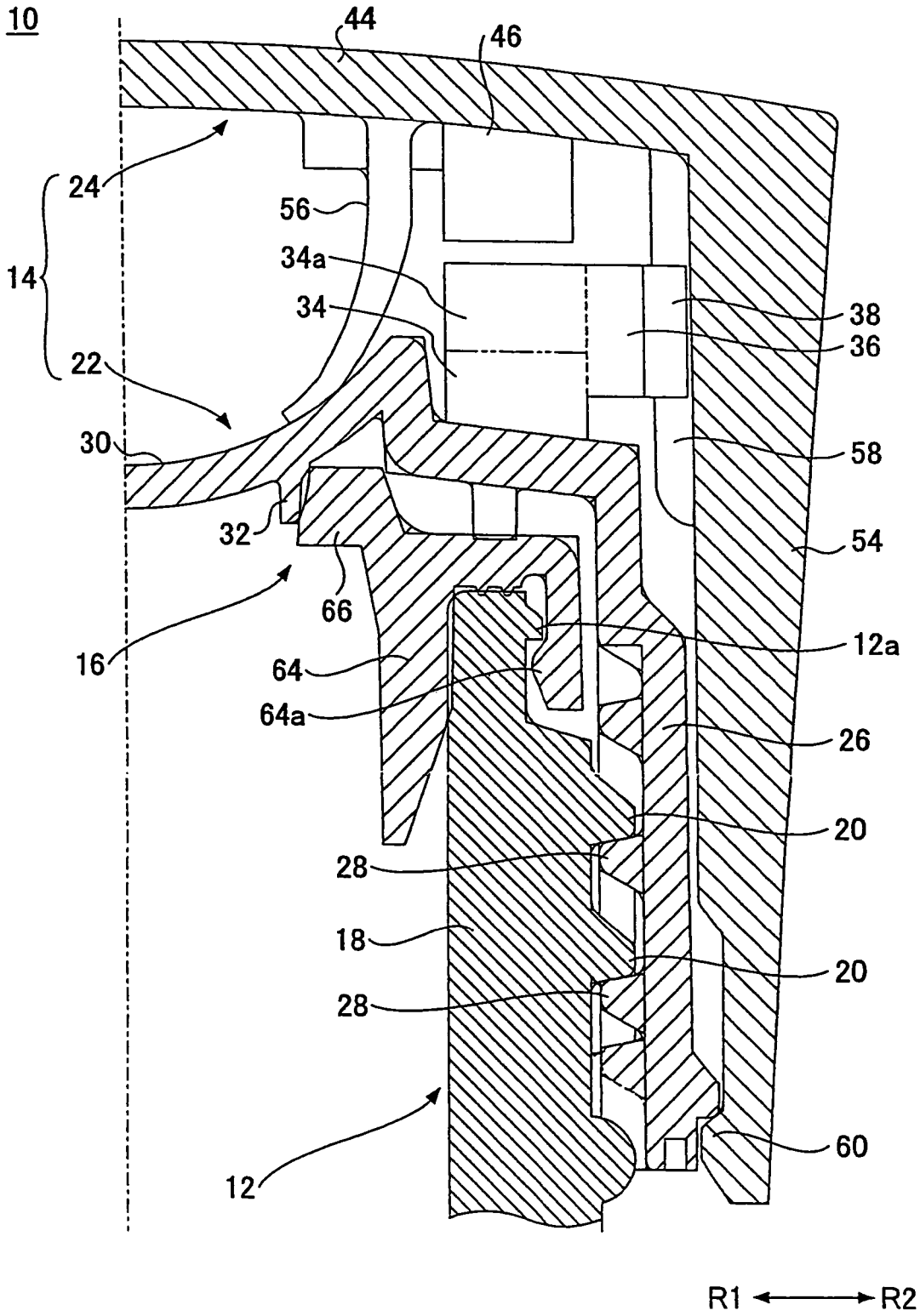
FIG. 1 is a partial cross-sectional view of a safety container of an embodiment of the present invention.
Figure 2:
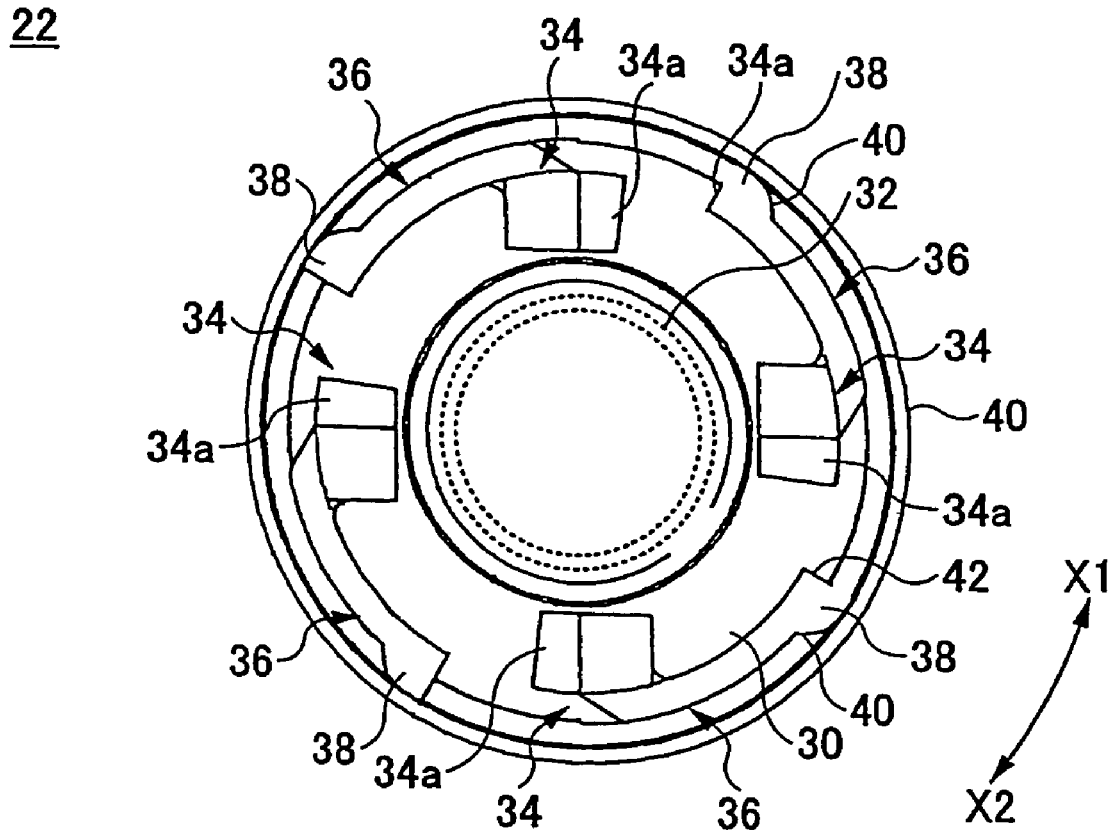
FIG. 2 is a top view of an internal cap of the safety container of the embodiment of the present invention.
Figure 3:
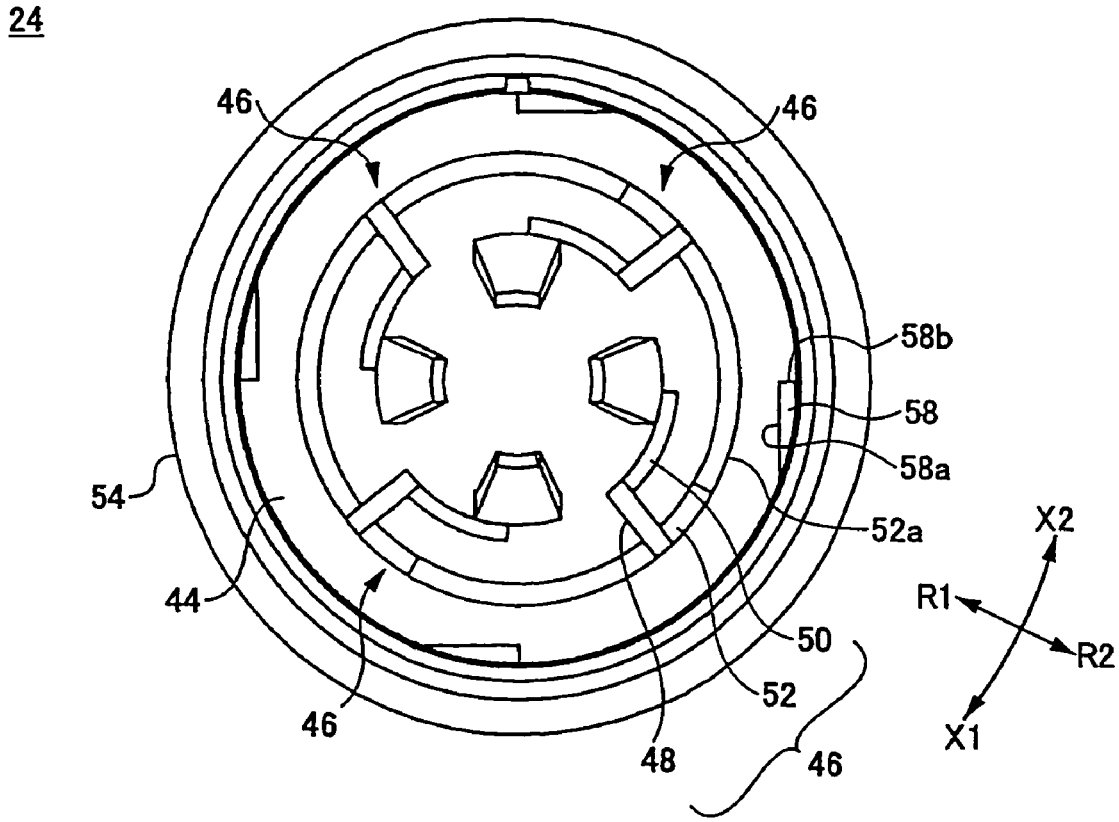
FIG. 3 is a bottom view of an external cap of the safety container of the embodiment of the present invention.

A description is now given, with reference to FIG. 1 through FIG. 3, of embodiments of the present invention. FIG. 1 is a partial cross-sectional view of a safety container of the embodiment of the present invention. FIG. 2 is a top view of an internal cap of the safety container of the embodiment of the present invention. FIG. 3 is a bottom view of an external cap of the safety container of the embodiment of the present invention.

A safety container 10 of an embodiment of the present invention includes a container main body 12, a cap 14 and an inner ring 16. The container main body 12 is made of, for example, polyethylene, polypropylene, or glass. A thread 20 is formed on a periphery wall external surface of an opening part 18 of the container main body 12.

The cap 14 includes an internal cap 22 and an external cap 24. The internal cap 22 and the external cap 24 are made of hard resin material such as polypropylene. The internal cap 22 includes a periphery wall 26 and a top wall 30. The top wall 30 is connected to the periphery wall 26. A center part of the top wall 30 is curved downward so as to have a concave-shaped configuration.

A thread 28 engaging with the thread 12 of the container main body 12 is formed on an internal surface of the periphery wall 26 of the internal cap 22. A periphery projection 32 having a circular ring shaped configuration is formed facing downward in a center part of the internal surface of the top wall 30. Furthermore, four internal projections 34 project upward from an external periphery part of the top wall 30. An engaging surface 34*a* is formed on the internal projection 34 so as to face a periphery direction, namely the X1-X2 direction in FIG. 2.

An engaging plate 36 is provided at a part separated from the top wall 30 on an external side surface of the internal projection 34 so as to be extended in a direction along the periphery wall 26. A projection part 38 is formed at an end part of the engaging plate 36. The projection part 38 includes a tilt surface 40 wherein a width is spread toward an external periphery side and a stand surface 42 facing to the periphery direction.

The external cap 24 includes a top wall 44 and an external periphery wall (periphery wall) 54 formed so as to be connected to an external periphery of the top wall 44. Four external projections 46 are provided on the external cap 24 so as to be formed projecting downward on an internal surface of the external periphery part of the top wall 44.

An engaging surface 48 is formed in the internal projection 46 so as to face a periphery direction, namely the X1-X2 direction in FIG. 3. An internal periphery plate 50 and an external periphery plate 52 having arc-shaped configurations are formed on corresponding sides in a radial direction, namely the R1-R2 direction in FIG. 3, of the engaging plate 48 with a designated interval so as to extend in a periphery direction. A head end 52*a* of the external periphery plate 52 is formed in a low step state. The external periphery plate 52 is connected to a lower part of the engaging plate 48 of the neighboring external projection 46.

In addition, four elastic bodies 56 are provided at an inside of a part where an external projection 46 of a top wall 44 is formed, so as to be formed extending downward. The elastic body 56 is curved toward a center side (in an R1 direction in FIG. 1) so as to have a concave-shaped configuration.

Four engaging projections 58 are projected from an upper part of the internal surface of the external periphery wall 54 of the external cap 24. An internal surface of the engaging projection 58 facing a center side (in an R1 direction in FIG. 3) is a tilt surface 58*a*. A side surface formed between the internal surface and the external surface of the engaging projection 58 is an engaging surface 58*b*.

The external cap 24 having the above-discussed structure is fitted to the internal cap 22 rotatably and moveably in upper and lower directions. A periphery projection part 60 is formed on an inner surface of a lower part of the external periphery wall 54 of the external cap 24. A periphery step part 62 is formed on an external surface of a lower part of the periphery wall 26 of the internal cap 22. The periphery projection part 60 and the periphery step part 62 are engaged so that the internal cap 22 is prevented from being left out from the external cap 24.

The inner ring 16 is made of soft resin such as linear low density polyethylene. An engaging part 64 having a periphery groove shaped configuration is formed at an external periphery part of the inner ring 16. A slide contact part 66 having a ring shaped configuration is formed at an inner periphery part of the inner ring 16. A periphery projection part 64*a* is formed on an internal surface of a groove of the engaging part 64. A periphery projection part 12*a* is formed on an external surface of a upper part of the opening part 18 of the container main body 12. In a state where the upper part of the opening part 18 of the container main body 12 is fitted to the engaging part 64, the periphery projection part 64*a* is engaged with the periphery projection part 12*a* so that the inner ring 16 is engaged with the opening part 18 of the container main body 12.

Next, an action of the safety container 10, namely an opening and closing mechanism of the cap, of this embodiment of the present invention is discussed.

First, a case where the cap 14 is closed is discussed. By rotating the external cap 24 in the closing direction (X2 direction in FIG. 3), the engaging surface 58*b* of the engaging projection 58 comes in contact with the stand surface 42 of the engaging plate (projection part) 36 so as to engage the engaging plate 36, and the internal cap 22 is rotated together with the external cap 24 so that the opening part 18 of the container main body 12 is closed. In this case, if the rotation angle reaches 90 through 120 degrees just before the close, the external surface of the periphery projection 32 of the internal cap 22 engaging the opening part 18 of the container main body 12 and moving downward slides and contacts the slide contact part 66 of the inner ring 16 and rotates. As a result of this, the container main body 12 is sealed at a contact part of the slide contact part 66 and the periphery projection 32.

Next, a case where the cap 14 is opened is discussed.

If the external cap 24 is rotated in the opening direction (X1 direction in FIG. 3), the tilt surface 58*a* of the engaging projection 58 is slid at the tilt surface 40 so that the engaging projection 58 is not engaged with the engaging plate 36 and the external cap 24 is not rotated with the internal cap 22.

On the other hand, if the external cap 24 is pressed to a side of the internal cap 22, the elastic body 56 is bent and exerts a force on the inner cap 22. At this position or a position where the external cap 24 is slightly rotated in the opening direction, the engaging plate 48 of the external projection 46 is engaged with the engaging surface 34*a* of the inner projection 34. If the external cap 24 is rotated in the opening direction in this state, the internal cap 22 is rotated together with the external cap 24 so that the cap 14 is opened from the container main body 12.

In this case, until the top wall 30 of the inner ring 16 floats from the engaged opening part 18 of the container main body 12, that is, until the rotation angle of the cap 14 reaches 90 through 120 degrees from a starting point of the rotation for example, the cap 14 is rotated while the external surface of the periphery projection 32 of the inner ring 16 slides and contacts the slide contact part 66. Hence, a designated force for rotating the cap 14 is required due to the sliding contact resistance.

The external cap 24 is further rotated so that the periphery projection 32 of the inner ring 16 floats from the opening part 18 so that the slide contact resistance is gone. After this, the cap 14 is rotated with a small force so that the cap 14 can be opened and separated from the container main body 12.

In the safety container 10 of this embodiment discussed above, since a designated force is required to press the cap and rotate the cap to a designated angle, for example, even if a little child who can exert only a weak force presses the cap in error, the little child cannot rotate the cap and therefore the cap cannot be opened.

In this case, the designated force required for rotating to the designated angle can be set by properly selecting materials of the periphery projection 32 and the slide contact part 66 and adjusting the configuration or measurement of the periphery projection 32 and the slide contact part 66.

In this case, pitches of the threads 20 and 28 are considered. In addition, in a case where the contact part of the slide contact part 66 and the periphery projection 32 is formed by, for example, an elastic body having a concave and convex structure such as uneven mount-shaped projection part or latch structure, the slide contact resistance in a case where the inner ring is rotated in the closing direction can be made smaller than the slide contact resistance in a case where the inner ring is rotated in the opening direction Furthermore, in the safety container 10 of this embodiment of the present invention, the resistance when the cap is rotated while the cap being pressed can be made large, by making either a tilt angle of the tilt surface 58*a* of the engaging project 58 or the tilt surface 40 of the engaging plate 36 or tilt angles of both of them large, by making either a thickness in an R1-R2 direction of the engaging project 58 or the engaging plate 36 or thicknesses in the R1-R2 direction of both of them large, or by combining such a change of the configuration. Hence, it is possible to achieve the same effect as the effect discussed above.

According to the above-discussed embodiment, it is possible to provide a safety container, including: a container main body; an internal cap configured to be fit to an opening part of the container main body; and an external cap configured to be fit to the internal cap rotatably and moveably in upper and lower directions;

wherein the external cap is not rotated with the internal cap in a case where only the external cap is rotated in an opening direction;

wherein the external cap is rotated in a state where the external cap is pressed toward an internal cap side so that the external cap and the internal cap are engaged and the internal cap is opened and separated from the container main body;

wherein the safety container further comprises an inner ring having an end part where an engaging part engaged at a top part of the opening part of the container main body is provided and another end part where a slide contact part is provided; and wherein the internal cap is rotated with the external cap while the internal cap slides and contacts the slide contact part, by rotating the external cap in the opening direction in a state where the external cap is pressed toward the internal cap side until a rotation angle reaches a designated angle.

Hence, it is possible to obtain a safety container wherein a cap cannot be easily pressed and rotated by a small force.

The present invention is not limited to these embodiments, but variations and modifications may be made without departing from the scope of the present invention.

The invention claimed is:

1. A safety container, comprising:

a container main body;

an internal cap configured to be fit to an opening part of the container main body; and an external cap configured to be fit to the internal cap rotatably and moveably in upper and lower directions;

wherein the external cap is not rotated with the internal cap in a case where only the external cap is rotated in an opening direction;

wherein the external cap is rotated in a state where the external cap is pressed toward an internal cap side so that the external cap and the internal cap are engaged and the internal cap is opened and separated from the container main body;

wherein the safety container further comprises an inner ring having an end part where an engaging part is provided that engages a top part of the opening part of the container main body both in a state where the internal cap is not separated from the container main body and a state where the internal cap is separated from the container main body, and another end part where a slide contact part is provided; and wherein the internal cap includes a periphery projection provided on an internal surface of a top wall so as to be formed downward; and wherein the internal cap is rotated with the external cap while the periphery projection slides and contacts the slide contact part, by rotating the external cap in the opening direction in a state where the external cap is pressed toward the internal cap side until a rotation angle reaches a designated angle.

2. The safety container as claimed in claim 1, wherein a contact part of the slide contact part of the inner ring and the periphery projection of the internal cap are formed by an elastic body having a concave and convex structure; and wherein an external surface of the periphery projection slides and contacts the slide contact part by rotating the external cap in the opening direction while the periphery projection and the slide contact part receive a resistance force greater than a resistance force generated by rotating the external cap in the closing direction.

3. A safety container, comprising:

a container main body;

a cap; and an inner ring;

wherein a thread is formed on a periphery wall external surface of an opening part of the container main body;

wherein the cap includes an internal cap and an external cap configured to be fit to the internal cap rotatably and moveably in upper and lower directions;

wherein a thread engaging with the thread of the container main body is formed on a periphery wall internal surface of the internal cap;

wherein the internal cap includes a periphery projection provided on an internal surface of a top wall so as to be formed downward;

an internal projection projecting upward from an external periphery part of the top wall; and an engaging plate fixed to a side surface of the internal projection, extending in a direction along a periphery wall, and having an end part where a projection part is formed;

wherein the projection part includes a tilt surface wherein a width is spread toward an external periphery side in a direction along an external periphery wall, and a stand surface provided in a center direction;

wherein the external cap includes an external projection provided on an external periphery part of an internal surface of a top wall so as to be formed projecting downward;

an engaging projection projecting from a periphery wall internal surface; and an elastic body provided on an internal surface of the top wall so as to be formed facing downward and exerting a force on the internal cap by being pressed;

wherein the inner ring includes an engaging part engaged at a top part of the opening part of the container main body and an internal surface where a slide contact part is provided;

wherein the engaging projection comes in contact with the stand surface of the projection part so as to engage the engaging plate, and the internal cap is rotated together with the external cap so that the opening part is closed by the top wall, by rotating the external cap in the closing direction;

wherein, in a case where only the external cap is rotated in an opening direction, the engaging projection is slid by the tilt surface of the projection so that the engaging projection is not engaged with the engaging plate and the external cap is not rotated with the internal cap; and wherein, by rotating the external cap in the opening direction in a state where the external cap is pressed to a side of the internal cap, the elastic body is bent, the external projection is engaged with the inner projection, and the internal cap is rotated together with the external cap while the external surface of the periphery projection slides and contacts the slide contact part, so that the opening part is opened from the top wall.

4. The safety container as claimed in claim 3, wherein an elastic concave and convex structure is provided at the periphery projection and the slide contact part so as to slide and contact while the external cap is rotated in the opening direction so that the periphery projection and the slide contact part receive a resistance force greater than a resistance force generated by rotating the external cap in the closing direction.

5. A safety container, comprising:

a container main body; and a cap;

wherein a thread is formed on a periphery wall external surface of an opening part of the container main body;

wherein the cap includes an internal cap and an external cap configured to be fit to the internal cap rotatably and moveably in upper and lower directions;

wherein a thread engaging with the thread of the container main body is formed on a periphery wall internal surface of the internal cap;

wherein the internal cap includes an internal projection projecting upward from an external periphery part of the top wall;

an engaging plate fixed to a side surface of the internal projection, extending in a direction along a periphery wall, and having an end part where a projection part is formed;

wherein the projection part includes a tilt surface wherein a width is spread toward an external periphery side in a direction along an external periphery wall, and a stand surface provided in a center direction;

wherein the external cap includes an external projection provided on an external periphery part of an internal surface of a top wall so as to be formed projecting downward;

an engaging projection projecting from an internal surface of a periphery wall; and an elastic body provided on an internal surface of the top wall so as to be formed facing downward and exerting a force on the internal cap by being pressed;

wherein the engaging projection comes in contact with the stand surface of the projection part so as to engage the engaging plate, and the internal cap is rotated together with the external cap so that the opening part is closed by the top wall, by rotating the external cap in the closing direction;

wherein, in a case where only the external cap is rotated in an opening direction, the engaging projection is slid by the tilt surface of the projection so that the engaging projection is not engaged with the engaging plate and the external cap is not rotated with the internal cap;

wherein by rotating the external cap in the opening direction in a state where the external cap is pressed to a side of the internal cap, the elastic body is bent, and the external projection is engaged with the inner projection, wherein, until the rotation angle reaches a designated angle, the engaging projection is slid and contacted by the tilt surface while the engaging projection receives a designated resistance, and the internal cap is rotated together with the external cap, so that the opening part is opened from the top wall, and wherein a configuration of either the projection part or the engaging projection or configurations of both of the projection part and the engaging projection are adjusted so that a size of the resistance is adjusted.

* * * * *